US006068712A

United States Patent [19]

Yamane et al.

[11] Patent Number: 6,068,712

[45] Date of Patent: May 30, 2000

[54] STEEL PRODUCTS HAVING SUPERIOR WEATHERING, METHOD OF PRODUCING THE STEEL PRODUCTS, AND METHOD OF FORMING WEATHERING PROTECTIVE RUST ON STEEL PRODUCT SURFACES

[75] Inventors: Yasuyashi Yamane, Chiba; Kazuhiko Shiotani, Kurashiki; Fumimaru Kawabata, Kurashiki; Toshiyuki Hoshino, Kurashiki; Keniti Amano, Kurashiki; Kimihiro Nishimura, Kurashiki, all of Japan

[73] Assignee: Kawasaki Steel Corporation, Kobe, Japan

[21] Appl. No.: 09/225,503

[22] Filed: Jan. 6, 1999

[30] Foreign Application Priority Data

| | | | |
|---|---|---|---|
| Jan. 8, 1998 | [JP] | Japan | 10-002645 |
| Jan. 20, 1998 | [JP] | Japan | 10-008218 |
| Mar. 17, 1998 | [JP] | Japan | 10-066541 |

[51] Int. Cl.[7] ..... C23C 8/80

[52] U.S. Cl. ..... 148/277; 148/284; 148/287; 428/472.2

[58] Field of Search ..... 148/284, 287, 148/277; 428/472.2, 629; 427/255.19, 255.26

[56] References Cited

U.S. PATENT DOCUMENTS

| | | | |
|---|---|---|---|
| 3,877,977 | 4/1975 | Watanabe et al. | 428/336 |
| 4,094,670 | 6/1978 | Bruno et al. | 75/124 |
| 4,448,612 | 5/1984 | Ebert et al. . | |
| 5,407,492 | 4/1995 | Ohmi et al. . | |

FOREIGN PATENT DOCUMENTS

| | | |
|---|---|---|
| 2522020 | 8/1983 | France . |
| 39 91 748 T1 | 10/1991 | Germany . |
| 44 24 638 A1 | 4/1996 | Germany . |
| 49-11739 | 2/1974 | Japan . |
| 54-120246 | 9/1979 | Japan . |
| 58-197282 | 11/1983 | Japan . |
| 1-142088 | 6/1989 | Japan . |
| 6-136557 | 5/1994 | Japan . |
| 6-264256 | 9/1994 | Japan . |
| 7-37672 | 4/1995 | Japan . |
| 8-13158 | 1/1996 | Japan . |
| 2572447 | 10/1996 | Japan . |
| 10-287958 | 10/1998 | Japan . |
| WO 95/18247 | 7/1995 | WIPO . |

OTHER PUBLICATIONS

ASM Handbook, Formerly Ninth Edition, Metals Handbook, vol. 13, Corrosio, pp. 516–521 and 1305–1306, Sep. 1987.

*Primary Examiner*—Prince Willis
*Assistant Examiner*—Andrew L. Oltmans
*Attorney, Agent, or Firm*—Oliff & Berridge, PLC

[57] ABSTRACT

The invention provides a steel product having superior weathering which is coated with a rust layer containing 50 or more weight % of non-crystalline rust, a method of producing the steel product, and a method of forming weathering protective rust on a material surface of the steel product. A material of a steel product is placed in an atmosphere in which the dew point is kept constant and the temperature of the steel product material is repeatedly varied between a temperature range of 5° C. or more higher than the dew point and a temperature range of 5° C. or more lower than the dew point. Weathering protective rust is thereby formed on the material surface of the steel product and a steel product having superior weathering is obtained. Preferably, the atmosphere contains 15 to 50 volume % of oxygen gas, and the temperature of the steel product is varied at a rising rate of 0.1 to 2° C./minute and a lowering rate of 0.01 to 2° C./minute. Alternatively, a desired steel product can also be obtained by placing a material of the steel product in an atmosphere containing 15 to 50 volume % of oxygen gas, keeping constant the dew point in the atmosphere, and keeping the temperature of the steel product material in the atmosphere at a certain value in a temperature range between a temperature 5° C. lower than the dew point and a temperature 20° C. lower than the dew point; or by placing a material of the steel product in an atmosphere containing 15 to 50 volume % of oxygen gas, and forming and keeping a water film with a thickness not more than 500 μm but not less than 50 μm on a material surface of the steel product.

20 Claims, 1 Drawing Sheet

STEEL PRODUCTS HAVING SUPERIOR WEATHERING, METHOD OF PRODUCING THE STEEL PRODUCTS, AND METHOD OF FORMING WEATHERING PROTECTIVE RUST ON STEEL PRODUCT SURFACES

BACKGROUND OF THE INVENTION

1. Field of Invention

The present invention relates to steel products having superior weathering, i.e., atmospheric corrosion resistance, a method of forming weathering protective rust on surfaces of steel products in a short period of time, and a method of producing the steel products having superior weathering based on the method of forming weathering protective rust.

2. Description of Related Art

Weathered steels containing one or more alloy elements, such as P, Cu, Cr and Ni, which are added in the steel to improve corrosion resistance in the atmosphere, are widely employed in steel structures such as ships and tanks, and steel buildings, such as bridges. In weathered steel, the so-called protective rust, i.e., rust hardly permeable to oxygen and water that are responsible for corrosion, is formed on steel surfaces after several years outdoors so that subsequent rusting is inhibited. Therefore, weathered steel is free from the need of coating with a corrosion-resistant paint, and thus provides an inexpensive and highly corrosion-resistant materials that can be used as is without painting. Also, the protective rust formed on the weathered steel is dark brown in color in comparison with reddish rust generated on plain steel, and is hence more harmonious with its surroundings. For those reasons, weathered steel has been more commonly used in recent years.

However, weathered steel requires a long period of time to manufacture, i.e., several years, to form the protective rust and generate flowed rust, called rust liquid, during that period. This raises problems from the point of harmonizing the weathered steel with its surroundings as well as causing environmental pollution. Another problem occurs in coastal areas because the protective rust is difficult to grow on weathered steel due to the action of salt particles flying from the sea, and, therefore, inhibition of rusting does not result.

To solve the problems described above, several proposals have been made. For example, Japanese Unexamined Patent Publication No. 49-11739 proposes steel products produced by forming rust on steel materials under an action of one or both of water and a corrosive liquid, and then forming a film, which is semipermeable to water on the rusted steel materials.

Japanese Unexamined Patent Publication No. 1-142088 discloses a surface treating method for weathered steel by which a surface of a steel plate is treated by an acid solution containing iron ions, and a phosphate coating is then formed on the treated surface.

Japanese Examined Patent Publication No. 7-37672 discloses a rusted weathered steel plate which is treated with a rusting liquid having a special composition.

Japanese Unexamined Patent Publication No. 6-136557 discloses a surface treating method for steel materials with which an aqueous solution of chromium sulfate or copper sulfate is coated on steel materials and after drying of moisture, an organic resin coating is formed on the steel materials. Further, Japanese Unexamined Patent Publication No. 8-13158 describes a surface treating method for steel materials with which an aqueous solution containing aluminum ions is coated on steel materials and after drying of moisture, an organic resin coating is formed on the steel materials.

Japanese Patent No. 257247 discloses steel products having high weathering in coastal areas, which contain very small amounts of Si and S, are combined with Ni, Al and Nb and contain a composite oxide of Al and Ca.

Additionally, Japanese Unexamined Patent Publication No. 6-264256 discloses steel products having high weathering wherein surfaces of the steel product are covered by a rust layer having a crystal grain size not larger than 200 nm in terms of means crystal grain diameter.

The related techniques described above, however, have several problems as described below. With the techniques disclosed in Japanese Unexamined Patent Publication No. 49-11739 and Japanese Examined Patent Publication No. 7-37672, when the steel products are exposed to the atmosphere, corrosion is inhibited in an initial stage, but rusting progresses after the initial stage. It is, hence, impossible to perfectly prevent formation of flowed rust and the effluence of iron ions. In addition, both of the steel products have problems associated with handling the materials because treatment liquids mixed with chemicals are used in the production process.

With the techniques disclosed in Japanese Unexamined Patent Publication No. 1-142088, weathering rust is formed in a shorter period of time than the predecessor techniques, but the coating color is black in an initial stage. Therefore, rusting progresses at different speeds due to a difference in the exposure environment between places that are exposed to direct sunlight and those in the shade. This makes the surface color non-uniform and raises a problem with the appearance of the material.

With the techniques disclosed in Japanese Unexamined Patent Publication No. 6-136557 and No. 8-13158, weathering the rust is developed in a short period of time, but problems are experienced due to complexity of the treatment process and the high cost of the surface treatment solution. Furthermore, the steel products produced in accordance with the technique disclosed in Japanese Patent No. 257447 have the problem that the surface color becomes non-uniform depending on environmental conditions and thus, the weathering of the steel products is insufficient.

SUMMARY OF THE INVENTION

An object of the present invention is to effectively solve the problems described above in the related art, and to provide a steel product having superior weathering properties which can prevent the occurrence of flowed rust and can maintain improved weathering even when used in a coastal area, a method of forming a weathering protective rust on a surface of a steel product which can form the weathering protective rust in a short period of time in an economically efficient manner, and a method of producing the steel product having superior weathering based on the method of forming weathering protective rust.

More specifically, according to one aspect of the invention, the invention provides a steel product having superior weathering, the steel product having a rust layer formed on a surface thereof, wherein the rust layer contains 50 or more weight % of non-crystalline rust.

According to another aspect of the invention, the invention provides a method of forming weathering protective rust on a surface of a steel product, the method comprising the steps of placing the steel product in an atmosphere in which the dew point is kept constant and repeatedly varying the temperature of the steel product in the atmosphere between a temperature range of 5° C. or more higher than the dew point and a temperature range of 5° C. or more lower than the dew point.

According to this embodiment, the atmosphere preferably contains 15 to 50 volume % of oxygen gas.

According to this embodiment, the temperature of the steel product is preferably varied at a rising rate of 0.1 to 2° C./minute and a falling rate of 0.01 to 2° C./minute.

According to another aspect of the invention, the invention provides a method of forming weathering protective rust on a surface of a steel product, the method comprising the steps of placing the steel product in an atmosphere containing 15 to 50 volume % of oxygen gas, keeping constant the dew point in the atmosphere, and keeping the temperature of the steel product in the atmosphere at a certain value in a temperature range between a temperature 5° C. lower than the dew point and a temperature 20° C. lower than the dew point.

Preferably, during a period in which the temperature of the steel product is kept at the certain value in the temperature range, the temperature of the steel product is temporarily kept at a temperature not lower than the dew point for five or more minutes.

According to another aspect of the invention, the invention provides a method of forming weathering protective rust on a surface of a steel product, the method comprising the steps of placing the steel product in an atmosphere containing 15 to 50 volume % of oxygen gas, and forming and keeping a water film with a thickness not more than 500 μm but not less than 50 μm on a surface of the steel product.

During a period in which the water film is formed and kept, the water film is preferably temporarily kept at a thickness of less than 50 μm for five or more minutes.

According to another aspect of the invention, the invention provides a method of producing a steel product having superior weathering, the method comprising the steps of placing the steel product in an atmosphere in which the dew point is kept constant, and repeatedly varying the temperature of the steel product in the atmosphere between a temperature range of 5° C. or more higher than the dew point and a temperature range of 5° C. or more lower than the dew point.

According to another aspect of the invention, the invention provides a method of producing a steel product having superior weathering, the method comprising the steps of placing the steel product in an atmosphere containing 15 to 50 volume % of oxygen gas, keeping constant the dew point in the atmosphere, and keeping the temperature of the steel product in the atmosphere at a certain value in a temperature range between a temperature 5° C. lower than the dew point and a temperature 20° C. lower than the dew point.

According to another aspect of the invention, the invention provides a method of producing a steel product having superior weathering, the method comprising the steps of placing the steel product in an atmosphere containing 15 to 50 volume % of oxygen gas, and forming and keeping a water film with a thickness not more than 500 μm but not less than 50 μm on a surface of the steel product.

With the present invention, protective rust can be formed in a short period of time in an economically efficient manner, and the occurrence of flowed rust can be prevented. In addition, steel products having sufficient weathering to be usable in coastal areas can be produced, and valuable advantages can be obtained from an industrial point of view.

The features of the present invention will be more apparent from the following description and the attached figure.

BRIEF DESCRIPTION OF THE DRAWINGS

The exemplary embodiments of the invention will be described in detail, with reference to the following figure in which.

DETAILED DESCRIPTION OF PREFERRED EMBODIMENTS

Basic Concept of the Invention

Figure 1:
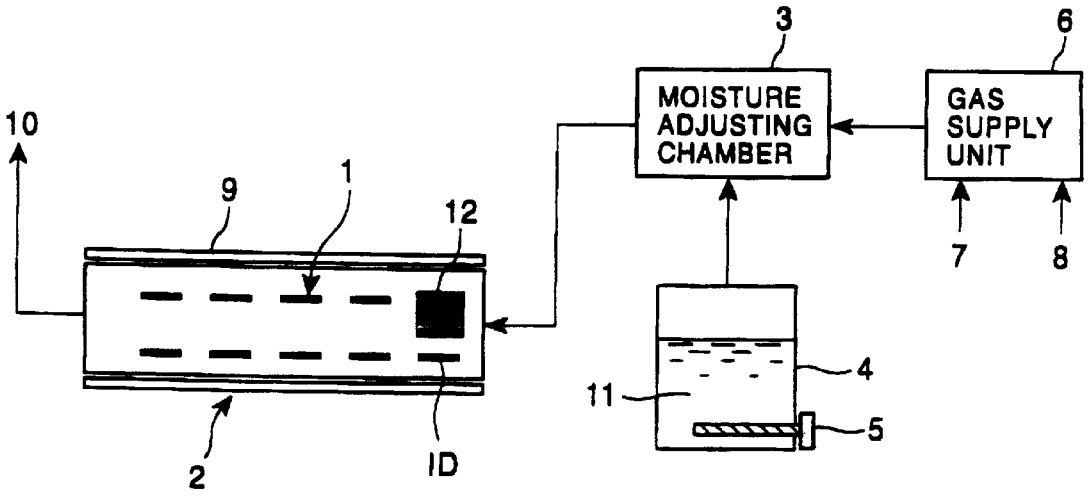
FIG. 1 is a schematic diagram showing modeled equipment for forming a protective rust which is suitable for implementing the present invention.

With the view of achieving the objects described above, the inventors first analyzed the properties of protective rust.

Using a polarizing microscope, the inventors observed a section of rust generated on surfaces of steel plates which had been exposed to the atmosphere for 25 or more years in both fields and coastal areas. As a result of these observations, it was found that the rust generated in fields exhibited polarization and extinction in a large portion, whereas the rust generated in coastal areas barely exhibited polarization and extinction. Also, the corroding rate of the steel plate exposed in a field was substantially zero. On the other hand, the steel plate exposed in the coastal area continued rusting at a corroding rate that was not so fast as observed in the initial stage of the exposure, but about ⅓ of the initial corroding rate. From the above findings, the inventors inferred that the extinction-developing portion of the rust had the function of inhibiting permeation of oxygen and water, which are responsible for corrosion, to the surface of the ground iron.

Then, the inventors conducted an experiment by leaving a steel plate which had been exposed to the elements for 15 years in a field and had exhibited extinction in a large portion when observed with a polarizing microscope, in a coastal area to be exposed to that atmosphere for a period of three or more additional years. As a result of the experiment, the occurrence of flowed rust and an increase of the corroding rate were not observed. This result suggests that once a protective rust is formed, the protective rust is stable even under the presence of sea-salt particles. Based upon this suggestion, the inventors reached the concept that by forming a protective rust on surfaces of steel products before they are practically employed in the atmosphere, it is possible to obtain steel products which do not generate flowed rust, do not become non-uniform in surface color, and which are durable enough for use in coastal areas.

Based upon the studies described above, the inventors made intensive studies to develop a method of forming protective rust on surfaces of steel products in a short period of time during the production process. As a result, the inventors discovered that rust exhibiting extinction under observation with a polarizing microscope can be created by: 1.) repeatedly raising and lowering the temperature of steel product between a temperature range of 5° C. or more lower than the dew point, which is determined depending on relative humidity, and a temperature range of 5° C. or more higher than the dew point; 2.) keeping the temperature of steel product at a constant value between a temperature 5° C. lower than the dew point, which is determined depending on relative humidity, and a temperature 20° C. lower than the dew point; or 3.) forming a water film with a thickness that is not more than 500 μm but not less than 50 μm on the surfaces of the steel product and keeping the water film in such a condition.

Further, the inventors analyzed using X-ray diffraction the properties of weathering protective rust, including rust that exhibited extinction under observation of a polarizing microscope. As a result, it was found that the weathering protective rust was a rust containing 50 weight % or more of non-crystalline rust.

The present invention was developed by conducting additional studies on the basis of the findings described above.

Preferred Embodiment

A method of producing steel products having superior weathering according to the invention and a method of forming weathering protective rust on surfaces of steel products is first described below.

According to a method of the present invention, steel products are held in an atmosphere where the dew point is kept at a constant temperature. It is not required that the temperature at which the dew point is kept be particularly limited so long as dew condensates on the steel products. The dew point is suitably adjusted by spraying water into the atmosphere gas. To obtain a predetermined protective rust layer, pure water is preferably used as the water to be sprayed.

Also, in the atmosphere in which the steel products are kept, it is preferable to not only hold the dew point constant, but also maintain the partial pressure of oxygen gas in the range of 15 to 50 volume %. If the partial pressure of the oxygen gas is less than 15 volume %, the corroding rate is so small that a long period of time is required to form a protective rust and production efficiency is significantly reduced. Conversely, if the partial pressure of the oxygen gas is more than 50 volume %, corrosion does not progress to be passived. For these reasons, the partial pressure of the oxygen gas is preferably maintained in the range of 15 to 50 volume %. Also, preferably, the partial pressure of the oxygen gas is adjusted by mixing oxygen gas in nitrogen gas, and the mixed oxygen gas has a purity as high as possible so that a predetermined protective gas is obtained.

Under conditions where the steel products are kept in the above-mentioned atmosphere, the temperature of the steel products is repeatedly varied between a temperature range not lower than the dew point +5° C., and a temperature range not higher than the dew point −5° C. By causing the temperature of the steel products to reciprocate between the temperature ranges, not lower than the dew point +5° C. and the temperature range not higher than the dew point −5° C., the surfaces of the steel products are repeatedly subject to dew condensation and drying so that the progress of corrosion is expedited and a protective rust is formed in a short period of time. Keeping the temperature of the steel products in each of the above temperature ranges for a certain period of time is not particularly required. By keeping the temperature of the steel products in each of the above temperature ranges for 1 to 60 minutes, however, the number of repetitions of rising and dropping temperature cycling to be made within a certain period of time can be reduced.

If the temperature of the steel products is lower than the dew point +5° C. or higher than the dew point −5° C., the surfaces of the steel products are unstably subject to dew condensation and drying, thus resulting in no progress of corrosion and a difficulty in forming a protective rust layer.

Preferably, the temperature of the steel products is raised and lowered between a temperature range not lower than the dew point +5° C. and a temperature range not higher than the dew point −5° C., at a rising rate of 0.1 to 2° C./minute and a dropping rate of 0.01 to 2° C./minute. If the rate of temperature increase is lower than 0.1° C./minute, the time required for raising the temperature of the steel product is too long, thus resulting in lower efficiency. Conversely, if the rate of temperature increase is higher than 2° C./minute, an extinction-developing layer is difficult to grow on the surfaces of the steel products. Also, if the rate of temperature decrease is lower than 0.01° C./minute, the time required for raising the temperature of the steel products is too long, thus resulting in lower efficiency. Conversely, if the rate of temperature decrease is higher than 2° C./minute, dew condensation does not occur easily and an extinction-developing layer is difficult to grow on the surfaces of the steel products.

In a condition where the steel products are kept in the above-mentioned atmosphere, the temperature of the steel products is kept at a constant temperature in the range not higher than the dew point −5° C. but not lower than the dew point −20° C. By keeping the temperature of the steel products in the above range, the surfaces of the steel products are maintained in an appropriate wetting state, and the protective rust can be formed in a short period of time. If the temperature of the steel products is higher than the dew point −5° C., the surfaces of the steel products are unstably subject to dew condensation and drying, thus resulting in no progress of corrosion and a difficulty in forming a protective rust layer.

Conversely, if the temperature of the steel products is lower than the dew point −20° C., the progress of corrosion is expedited to such an extent that a detrimental rust layer (described later), i.e., $Fe_3O_4$, is generated. For these reasons, the temperature of the steel products is kept constant in the range not higher than the dew point −5° C. but not lower than the dew point −20° C. During the treatment time, preferably, the temperature of the steel products is raised to a temperature not lower than the dew point, and is kept in such a condition for a certain period of time. This increases the ratio of the extinction-developing rust to the total rust. The effect of keeping the temperature of the steel products in the above condition is apparently confirmed when a keeping time is not shorter than five minutes.

Moreover, by forming a water film with a thickness not more than 500 $\mu$m but not less than 50 $\mu$m on surfaces of steel products and keeping the water film in such a condition while the steel products are held in the above-mentioned atmosphere, an appropriate wetting state is maintained and the protective rust can be formed in a short period of time. If the thickness of the water film is more than 500 $\mu$m, the progress of corrosion is expedited to such an extent that detrimental rust (described later), i.e., $Fe_3O_4$, is generated. The ratio of the extinction-developing rust to the total rust is increased by temporarily holding the steel products in a condition in which the thickness of the water film is kept less than 50 $\mu$m, for a certain period of time during the treatment process. The effect of keeping the water film covering the steel products in the above condition is apparently confirmed when a keeping time is not shorter than five minutes.

Any type of steel products, including steel plates, steels sheets and shaped steels, are suitable for use in the present invention. Also, the steel products are not particularly required to have a limited composition. Plain steel and weathering steel are both suitably usable, but it is preferable to use weathering steel with P, Cu, Cr, Ni, etc. added from the viewpoint of increasing corrosion resistance.

The term "weathering protective rust" used herein implies rust that is found as a portion exhibiting extinction when observed using a polarizing microscope. To inhibit the progress of corrosion, the thickness of extinction-developing rust, i.e., the thickness of rust that is observed as a portion exhibiting extinction, is preferably at least 0.5 or more times the total rust thickness. Also, the term "weathering protective rust" used herein implies rust that contains non-crystalline rust in a relatively large amount when analyzed with X-ray diffraction. Thus, the steel products having superior weathering of the present invention are featured in that a rust layer is formed on a surface of the steel product and the rust layer contains 50 weight % or more of non-crystalline rust.

The term "non-crystalline rust" used herein implies a portion of formed rust which is determined by measuring the content of crystalline rust in a rust layer formed on the steel product surface with X-ray diffraction, and subtracting the content of crystalline rust from the total amount of the rust layer.

In non-crystalline rust, crystal grains cannot be defined and no grain boundaries exist. Therefore, non-crystalline rust has higher corrosion resistance than crystalline rust that potentially allows intrusion of corroding factors through grain boundaries. Because it has good adhesion to the steel product surface, non-crystalline rust can also form a firmer rust layer as a result of repeated drying and moistening during the period of exposure. It is further thought that non-crystalline rust contains a large amount of water, and the water functions to fill microscopic gaps in a rust layer, thereby eventually densifying the rust layer, preventing intrusion of corroding factors, and improving weathering of the steel products. In the case of using weathered steel, components, such as Cr and Cu, eluted from the ground iron due to exposure, are mixed in a rust layer, and therefore the formed rust is even more protective from the weathering point of view.

In the steel products having superior weathering according to the present invention, a rust layer formed on a surface of the steel product comprises rust that contains 50 weight % or more of non-crystalline rust. Such a rust layer is suitably formed by using one of the three treating methods described earlier. The content of the non-crystalline rust can be adjusted by adjusting a treatment time of each of the three treating methods described above.

By forming a rust layer which contains 50 weight % or more of non-crystalline rust, the occurrence of flowed rust is inhibited. On the other hand, if non-crystalline rust is less than 50 weight % or more of the rust layer, the formed rust layer is coarse and corrosion of the ground iron progresses until a weathering protective rust is formed, causing flowed rust to generate continuously. With the rust layer containing 50 weight % or more of non-crystalline rust, the occurrence of flowed rust is inhibited, but corrosion of the ground iron is not perfectly prevented. While iron is being eluted from the ground iron though in a small amount, a rust layer is slowly thickened and eventually becomes protective rust.

Examples of crystalline rust include α-FeOOH, γ-FeOOH, $Fe_3O_4$, and so on. However, any of these examples of crystalline rust has a small ability of inhibiting the occurrence according to of flowed rust. For this reason, in the steel products having superior weathering according to the present invention, the content of crystalline rust in the rust layer is set to be less than 50 weight %. Specifically, although a-FeOOH is stable in terms of thermodynamics, it is difficult to form a rust layer having good adhesion to it on the steel product surface. Also, γ-FeOOH is rust that is initially formed on the steel product surface exposed to the atmosphere. Under a wet environment, γ-FeOOH is reduced and changed into another form of rust. The effect of inhibiting the occurrence of flowed rust, developed by this type of rust, is, however, small. Further, $Fe_3O_4$ cannot eventually become protective rust and when formed on the steel product surface, it generates red rust under exposure to the atmosphere.

Implementing the present invention requires only a tank capable of holding the steel products, the ability to change the temperature of the steel products cyclically, a device capable of adjusting moisture in the atmosphere and a device capable of changing the partial pressure of oxygen gas in the atmosphere. With these tanks and devices, steel products having superior weathering on which the protective rust is formed, can be simply and inexpensively produced in a very short period of time i.e., within about one month.

EXAMPLES

Using modeling equipment for forming a protective rust, as shown in FIG. 1, rust was formed on specimens 5 mm high×50 mm wide×100 mm long which were cut out from steel plates having the compositions listed in Table 1, under conditions listed in Tables 2 to 3. Steel A was a plain steel and steel B was a weathered steel. Three specimens were prepared for each of the conditions. The specimens 1 were held in a rust forming tank 2 while a gas mixture properly adjusted in the dew point and the partial pressure of oxygen gas was continuously supplied to the rust forming tank 2. The specimens 1 were then subjected to treatment for forming rust by repeatedly varying the temperature of the specimens 1 between two predetermined temperature ranges shown in Table 1 by a temperature control heater 9 associated with the rust forming tank 2, or keeping the specimens 1 at a constant temperature as shown in Table 3, or adjusting the thickness of a water film formed on the specimens 1 as shown in Table 4. The specimens 1 were subject to the treatment for a period of 20 days.

TABLE 1

| Steel | C | Si | Mn | P | S | Al | Cr | Cu | Ni |
|---|---|---|---|---|---|---|---|---|---|
| A | 0.11 | 0.34 | 1.42 | 0.017 | 0.006 | 0.027 | — | — | — |
| B | 0.11 | 0.41 | 1.01 | 0.011 | 0.006 | 0.016 | 0.51 | 0.33 | 0.07 |

weight %

Additionally, the dew point was adjusted in a moisture adjusting chamber 3 by spraying water supplied from a humidifier 4 so that the specimens 1 had the predetermined dew point. Also, the partial pressure of oxygen gas in the atmosphere was adjusted by mixing oxygen gas 8 in nitrogen gas 7 so that the predetermined partial pressure of oxygen gas was obtained.

After the treatment, for each of the three specimens which were covered with rust over their entire surfaces, the specimen was cut at five points, and the cut sections were observed using a polarizing microscope to measure a ratio of the thickness of extinction-developing rust to the total rust thickness. Then, the formed rust was scraped off by a scraper and about 300 mg of rust was sampled for each of the specimens. Identification and quantitative analysis of rust components were made with X-ray diffraction using the internal standard method. ZnO was used as a standard substance. As a result of the analysis, α-FeOOH, γ-FeOOH and $Fe_3O_4$ were confirmed as crystalline rust. The amount i.e., weight of rust obtained by subtracting the amount (weight) of the crystalline rust from the total amount (weight) of the rust measured was determined as the amount, (weight) of the non-crystalline rust. The obtained results are listed in Table 2–4.

The two remaining specimens having rust formed thereon were exposed to the atmosphere for three months in a field and in a coastal area, respectively, and the occurrence of flowed rust was examined. The obtained results are listed in Tables 2–4. The occurrence of flowed rust was examined by visually observing how concrete lying under the specimen was contaminated by the flowed rust. Incidentally, in Tables, mark X represents that the occurrence of flowed rust was not found, and mark O represents that the occurrence of flowed rust was found.

TABLE 2-1

| Steel plate No. | Steel | Treatment conditions for forming protective rust: Dew point (° C.) | Oxygen partial pressure (vol. %) | Repeatedly varied temperatures: Temperature range below dew point: Temp. (° C.) | Keeping (sec) | Temperature range above dew point: Temp. (° C.) | Keeping (sec) | Temperature rising rate ° C./min | Temperature falling rate ° C./min | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|---|---|---|---|
| 1 | A | 20 | 20 | 13 | | 27 | | 1.0 | 1.0 | 0.65 | 61 | ○ | ○ | Inventive Example |
| 2 | B | | | | | | | | | 0.81 | 74 | ○ | ○ | Inventive Example |
| 3 | A | | 30 | 13 | | 30 | | 1.5 | 0.1 | 0.69 | 62 | ○ | ○ | Inventive Example |
| 4 | B | | | | | | | | | 0.82 | 73 | ○ | ○ | Inventive Example |
| 5 | A | | 20 | 10 | | 27 | | 0.3 | 0.0 | 0.71 | 64 | ○ | ○ | Inventive Example |
| 6 | B | | | | | | | | | 0.85 | 75 | ○ | ○ | Inventive Example |
| 7 | A | | 45 | 10 | | 30 | | 1.8 | 1.5 | 0.75 | 68 | ○ | ○ | Inventive Example |
| 8 | B | | | | | | | | | 0.84 | 74 | ○ | ○ | Inventive Example |
| 9 | A | | 40 | 17 | | 30 | | 1.8 | 0.1 | Too small amount of rust | — | X | X | Comparative Example |
| 10 | B | | | | | | | | | Too small amount of rust | — | X | X | Comparative Example |
| 11 | A | | 20 | 10 | | 23 | | 1.5 | 1.0 | 0.31 | 22 | X | X | Comparative Example |
| 12 | B | | | | | | | | | 0.42 | 35 | X | X | Comparative Example |

*: Mean value measured at five points,
**: Exposure for three months,
○: No flowed rust found,
X: Flowed rust found

TABLE 2-2

| Steel plate No. | Steel | Treatment conditions for forming protective rust: Dew point (° C.) | Oxygen partial pressure (vol. %) | Repeatedly varied temperatures: Temperature range below dew point: Temp. (° C.) | Keeping (sec) | Temperature range above dew point: Temp. (° C.) | Keeping (sec) | Temperature rising rate ° C./min | Temperature falling rate ° C./min | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|---|---|---|---|
| 13 | A | 30 | 20 | 23 | | 37 | | 1.0 | 1.8 | 0.67 | 63 | ○ | ○ | Inventive |
| 14 | B | | | | | | | | | 0.78 | 76 | ○ | ○ | Inventive |
| 15 | A | | 40 | 23 | | 40 | | 1.5 | 0.05 | 0.66 | 70 | ○ | ○ | Inventive |
| 16 | B | | | | | | | | | 0.75 | 71 | ○ | ○ | Inventive |
| 17 | A | | 15 | 20 | | 37 | | 0.3 | 0.08 | 0.71 | 68 | ○ | ○ | Inventive |
| 18 | B | | | | | | | | | 0.82 | 78 | ○ | ○ | Inventive |
| 19 | A | | 30 | 20 | | 40 | | 0.5 | 1.5 | 0.73 | 70 | ○ | ○ | Inventive |
| 20 | B | | | | | | | | | 0.86 | 82 | ○ | ○ | Inventive |
| 21 | A | | 55 | 15 | | 45 | | 1.8 | 0.05 | 0.57 | 52 | ○ | X | Inventive |
| 22 | B | | | | | | | | | 0.59 | 54 | ○ | X | Inventive |
| 23 | A | | 35 | 27 | | 40 | | 1.5 | 1.0 | Too small amount of rust | — | X | X | Comparative Example |
| 24 | B | | | | | | | | | Too small | — | X | X | Comparative |

TABLE 2-2-continued

| Steel plate No. | Steel | Treatment conditions for forming protective rust: Dew point (° C.) | Oxygen partial pressure (vol. %) | Repeatedly varied temperatures: Temperature range below dew point Temp. (° C.) | Keeping (sec) | Temperature range above dew point Temp. (° C.) | Keeping (sec) | Temperature rising rate ° C./min | Temperature falling rate ° C./min | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|---|---|---|---|
| | | | | | | | | | | amount of rust | | | | Example |
| 25 | A | | 20 | 20 | | 40 | | 2.3 | 1.0 | 0.55 | 54 | ○ | ○ | Inventive |
| 26 | B | | | | | | | | | 0.61 | 60 | ○ | ○ | Inventive |
| 27 | A | | 20 | 20 | | 40 | | 1.0 | 2.5 | 0.58 | 59 | ○ | ○ | Inventive |
| 28 | B | | | | | | | | | 0.64 | 61 | ○ | ○ | Inventive |

20

TABLE 2-3

| Steel plate No. | Steel | Treatment conditions for forming protective rust: Dew point (° C.) | Oxygen partial pressure (vol. %) | Repeatedly varied temperatures: Temperature range below dew point Temp. (° C.) | Keeping (sec) | Temperature range above dew point Temp. (° C.) | Keeping (sec) | Temperature rising rate ° C./min | Temperature falling rate ° C./min | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|---|---|---|---|
| 29 | A | 40 | 20 | 33 | | 47 | | 1.0 | 1.0 | 0.64 | 61 | ○ | ○ | Inventive Example |
| 30 | B | | | | | | | | | 0.81 | 77 | ○ | ○ | Inventive Example |
| 31 | A | | 30 | 33 | | 50 | | 0.5 | 0.50 | 0.63 | 58 | ○ | ○ | Inventive Example |
| 32 | B | | | | | | | | | 0.78 | 76 | ○ | ○ | Inventive Example |
| 33 | A | | 20 | 30 | | 47 | | 0.3 | 0.03 | 0.65 | 63 | ○ | ○ | Inventive Example |
| 34 | B | | | | | | | | | 0.77 | 74 | ○ | ○ | Inventive Example |
| 35 | A | | 40 | 30 | | 50 | | 0.5 | 1.5 | 0.64 | 60 | ○ | ○ | Inventive Example |
| 36 | B | | | | | | | | | 0.78 | 75 | ○ | ○ | Inventive Example |
| 37 | A | | 20 | 25 | | 55 | | 1.5 | 0.05 | 0.68 | 65 | ○ | X | Inventive Example |
| 38 | B | | | | | | | | | 0.85 | 81 | ○ | X | Inventive Example |
| 39 | A | | 30 | 37 | | 50 | | 1.5 | 1.0 | 0.21 | 14 | X | X | Comparative Example |
| 40 | B | | | | | | | | | 0.25 | 18 | X | X | Comparative Example |
| 41 | A | | 20 | 30 | | 50 | | 0.05 | 1.0 | 0.55 | 51 | ○ | ○ | Inventive Example |
| 42 | B | | | | | | | | | 0.58 | 53 | ○ | ○ | Inventive Example |
| 43 | A | | 10 | 30 | | 50 | | 1.0 | 1.0 | 0.54 | 53 | ○ | ○ | Inventive Example |
| 44 | B | | | | | | | | | 0.59 | 58 | ○ | ○ | Inventive Example |

TABLE 2-4

| Steel plate No. | Steel | Treatment conditions for forming protective rust: Dew point (° C.) | Oxygen partial pressure (vol. %) | Repeatedly varied temperatures: Temperature range below dew point Temp. (° C.) | Keeping (sec) | Temperature range above dew point Temp. (° C.) | Keeping (sec) | Temperature rising rate ° C./min | Temperature falling rate ° C./min | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|---|---|---|---|
| 45 | A | 50 | 20 | 43 | | 57 | | 1.0 | 1.0 | 0.65 | 61 | ○ | ○ | Inventive Example |
| 46 | B | | | | | | | | | 0.72 | 68 | ○ | ○ | Inventive Example |
| 47 | A | | 35 | 43 | | 60 | | 1.5 | 0.50 | 0.70 | 64 | ○ | ○ | Inventive Example |
| 48 | B | | | | | | | | | 0.84 | 80 | ○ | ○ | Inventive Example |
| 49 | A | | 25 | 40 | | 57 | | 0.3 | 0.03 | 0.69 | 60 | ○ | ○ | Inventive Example |
| 50 | B | | | | | | | | | 0.81 | 75 | ○ | ○ | Inventive Example |
| 51 | A | | 40 | 40 | | 60 | | 0.5 | 1.5 | 0.73 | 70 | ○ | ○ | Inventive Example |
| 52 | B | | | | | | | | | 0.83 | 81 | ○ | ○ | Inventive Example |
| 53 | A | | 55 | 35 | | 65 | | 1.8 | 0.05 | 0.55 | 52 | ○ | X | Inventive Example |
| 54 | B | | | | | | | | | 0.56 | 53 | ○ | X | Inventive Example |
| 55 | A | | 30 | 47 | | 53 | | 1.5 | 1.0 | 0.31 | 29 | X | X | Comparative Example |
| 56 | B | | | | | | | | | 0.43 | 38 | X | X | Comparative Example |
| 57 | A | | 20 | 40 | | 60 | | 1.50 | 0.005 | 0.53 | 52 | ○ | ○ | Inventive Example |
| 58 | B | | | | | | | | | 0.54 | 53 | ○ | ○ | Inventive Example |
| 59 | A | | 10 | 40 | | 60 | | 1.0 | 1.0 | 0.54 | 51 | ○ | ○ | Inventive Example |
| 60 | B | | | | | | | | | 0.59 | 58 | ○ | ○ | Inventive Example |

TABLE 3-1

| Steel plate No. | Steel | Treatment conditions for forming protective rust: Dew point (° C.) | Oxygen partial pressure (vol. %) | Constant temperature kept (° C.) | Keeping time at temperature above dew point relative to one-hour keeping of constant temperature (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|
| 1 | A | 20 | 20 | 5 | 0 | 0.62 | 60 | ○ | ○ | Inventive Example |
| 2 | B | | | | | 0.71 | 69 | ○ | ○ | Inventive Example |
| 3 | A | | 30 | 10 | 0 | 0.61 | 65 | ○ | ○ | Inventive Example |
| 4 | B | | | | | 0.69 | 67 | ○ | ○ | Inventive Example |
| 5 | A | | | 10 | (30° C. X) 10 | 0.67 | 69 | ○ | ○ | Inventive Example |
| 6 | B | | | | | 0.74 | 72 | ○ | ○ | Inventive Example |
| 7 | A | | 20 | 15 | 0 | 0.67 | 66 | ○ | ○ | Inventive Example |

TABLE 3-1-continued

| Steel plate No. | Steel | Treatment conditions for forming protective rust: Dew point (° C.) | Oxygen partial pressure (vol. %) | Constant temperature kept (° C.) | Keeping time at temperature above dew point relative to one-hour keeping of constant temperature (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|
| 8 | B | | | | | 0.72 | 68 | ○ | ○ | Inventive Example |
| 9 | A | | 45 | 20 | 0 | Too small amount of rust | — | ○ | ○ | Inventive Example |
| 10 | B | | | | | Too small amount of rust | — | ○ | ○ | Inventive Example |
| 11 | A | | 20 | 25 | 0 | Too small amount of rust | — | X | X | Comparative Example |
| 12 | B | | | | | Too small amount of rust | — | X | X | Comparative Example |
| 13 | A | | 20 | 30 | 0 | Too small amount of rust | — | X | X | Comparative Example |
| 14 | B | | | | | Too small amount of rust | — | X | X | Comparative Example |

*: Mean value measured at five points,
**: Exposure for three months,
○: No flowed rust found,
X: Flowed rust found

TABLE 3-2

| Steel plate No. | Steel | Treatment conditions for forming protective rust: Dew point (° C.) | Oxygen partial pressure (vol. %) | Constant temperature kept (° C.) | Keeping time at temperature above dew point relative to one-hour keeping of constant temperature (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|
| 15 | A | 30 | 20 | 8 | 0 | 0.45 | 48 | X | X | Comparative Example |
| 16 | B | | | | | 0.48 | 48 | X | X | Comparative Example |
| 17 | A | | 20 | 10 | 0 | 0.68 | 63 | ○ | ○ | Inventive Example |
| 18 | B | | | | | 0.77 | 74 | ○ | ○ | Inventive Example |
| 19 | A | | | | (40° C. X)3 | 0.67 | 63 | ○ | ○ | Inventive Example |
| 20 | B | | | | | 0.78 | 75 | ○ | ○ | Inventive Example |
| 21 | A | | 17 | 20 | 0 | 0.58 | 70 | ○ | ○ | Inventive Example |
| 22 | B | | | | | 0.75 | 74 | ○ | ○ | Inventive Example |
| 23 | A | | 20 | 23 | 0 | 0.61 | 60 | ○ | ○ | Inventive Example |
| 24 | B | | | | | 0.75 | 75 | ○ | ○ | Inventive Example |
| 25 | A | | 10 | 30 | 0 | Too small amount of rust | — | X | X | Comparative Example |
| 26 | B | | | | | Too small amount of rust | — | X | X | Comparative Example |
| 27 | A | | 48 | 40 | 0 | Too small amount of rust | — | X | X | Comparative Example |
| 28 | B | | | | | Too small amount of rust | — | X | X | Comparative Example |
| 29 | A | | 20 | 42 | 0 | Too small amount of rust | — | X | X | Comparative Example |
| 30 | B | | | | | Too small amount of rust | — | X | X | Comparative Example |

TABLE 3-3

| Steel plate No. | Steel | Treatment conditions for forming protective rust: Dew point (° C.) | Oxygen partial pressure (vol. %) | Constant temperature kept (° C.) | Keeping time at temperature above dew point relative to one-hour keeping of constant temperature (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|---|
| 31 | A | 40 | 20 | 18 | 0 | 0.24 | 26 | X | X | Comparative Example |
| 32 | B | | | | | 0.18 | 22 | X | X | Comparative Example |
| 33 | A | | 20 | 25 | 0 | 0.60 | 56 | ○ | ○ | Inventive Example |
| 34 | B | | | | | 0.79 | 75 | ○ | ○ | Inventive Example |
| 35 | A | | | | (50° C. X)6 | 0.65 | 60 | ○ | ○ | Inventive Example |
| 36 | B | | | | | 0.82 | 79 | ○ | ○ | Inventive Example |
| 37 | A | | 20 | 35 | 0 | 0.65 | 63 | ○ | ○ | Inventive Example |
| 38 | B | | | | | 0.64 | 64 | ○ | ○ | Inventive Example |
| 39 | A | | 10 | 25 | 0 | Too small amount of rust | — | X | X | Comparative Example |
| 40 | B | | | | | Too small amount of rust | — | X | X | Comparative Example |
| 41 | A | | 30 | 50 | 0 | Too small amount of rust | — | X | X | Comparative Example |
| 42 | B | | | | | Too small amount of rust | — | X | X | Comparative Example |
| 43 | A | | 20 | 53 | 0 | Too small amount of rust | — | X | X | Comparative Example |
| 44 | B | | | | | Too small amount of rust | — | X | X | Comparative Example |

35

TABLE 3-4

| Steel plate No. | Steel | Treatment conditions for forming protective rust: Dew point (° C.) | Oxygen partial pressure (vol. %) | Constant temperature kept (° C.) | Keeping time at temperature above dew point relative to one-hour keeping of constant temperature (min) | Rust layer: *Thickness of extinction-developing rust/ Total rust thickness | Non-crystal-line rust content (wt. %) | **Exposure test results: Fields area | Coastal area | Remarks |
|---|---|---|---|---|---|---|---|---|---|---|
| 45 | A | 50 | 30 | 15 | 0 | 0.18 | 23 | ○ | ○ | Comparative Example |
| 46 | B | | | | | 0.25 | 30 | ○ | ○ | Comparative Example |
| 47 | A | | 10 | 25 | 0 | Too small amount of rust | — | x | x | Comparative Example |
| 48 | B | | | | | Too small amount of rust | — | x | x | Comparative Example |
| 49 | A | | 25 | 40 | 0 | 0.62 | 61 | ○ | ○ | Inventive Example |
| 50 | B | | | | | 0.61 | 73 | ○ | ○ | Inventive Example |
| 51 | A | | | | (60° C. x)4 | 0.61 | 61 | ○ | ○ | Inventive Example |
| 52 | B | | | | | 0.61 | 74 | ○ | ○ | Inventive Example |
| 53 | A | | 30 | 50 | 0 | Too small amount of rust | — | x | x | Comparative Example |
| 54 | B | | | | | Too small amount of rust | — | x | x | Comparative Example |
| 55 | A | | 30 | 65 | 0 | Too small amount of rust | — | x | x | Comparative Example |
| 56 | B | | | | | Too small amount of rust | — | x | x | Comparative Example |

TABLE 4-1

| Steel plate No. | Steel | Treatment conditions for forming protective rust: Water film thickness (μm) | Oxygen partial pressure (vol. %) | Keeping time at water film thickness less than 50 μm relative to one-hour keeping of water film (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|
| 1 | A | 50 | 20 | 0 | 0.62 | 60 | ○ | ○ | Inventive Example |
| 2 | B | | | | 0.74 | 72 | ○ | ○ | Inventive Example |
| 3 | A | 100 | 30 | 0 | 0.66 | 62 | ○ | ○ | Inventive Example |
| 4 | B | | | | 0.76 | 72 | ○ | ○ | Inventive Example |
| 5 | A | | | (30 μm X)6 | 0.70 | 67 | ○ | ○ | Inventive Example |
| 6 | B | | | | 0.79 | 78 | ○ | ○ | Inventive Example |
| 7 | A | 200 | 40 | 0 | 0.66 | 63 | ○ | ○ | Inventive Example |
| 8 | B | | | | 0.65 | 63 | ○ | ○ | Inventive Example |
| 9 | A | 350 | 50 | 0 | 0.60 | 59 | ○ | ○ | Inventive Example |
| 10 | B | | | | 0.76 | 72 | ○ | ○ | Inventive Example |
| 11 | A | 250 | 10 | 0 | Too small amount of rust | — | X | X | Comparative Example |
| 12 | B | | | | Too small amount of rust | — | X | X | Comparative Example |
| 13 | A | 300 | 20 | 0 | 0.60 | 60 | ○ | ○ | Inventive Example |
| 14 | B | | | | 0.76 | 71 | ○ | ○ | Inventive Example |

*: Mean value measured at five points,
**: Exposure for three months,
○: No flowed rust found,
X: Flowed rust found

TABLE 4-2

| Steel plate No. | Steel | Treatment conditions for forming protective rust: Water film thickness (μm) | Oxygen partial pressure (vol. %) | Keeping time at water film thickness less than 50 μm relative to one-hour keeping of water film (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|
| 15 | A | 400 | 60 | 0 | Too small amount of rust | — | X | X | Comparative Example |
| 16 | B | | | | Too small amount of rust | — | X | X | Comparative Example |
| 17 | A | 100 | 50 | 0 | 0.62 | 63 | ○ | ○ | Inventive Example |
| 18 | B | | | | 0.64 | 62 | ○ | ○ | Inventive Example |
| 19 | A | | | (30 μm X)4 | 0.62 | 63 | ○ | ○ | Inventive Example |
| 20 | B | | | | 0.63 | 62 | ○ | ○ | Inventive Example |
| 21 | A | 300 | 40 | 0 | 0.63 | 62 | ○ | ○ | Inventive Example |
| 22 | B | | | | 0.74 | 73 | ○ | ○ | Inventive Example |
| 23 | A | 450 | 10 | 0 | Too small amount of rust | — | X | X | Comparative Example |

TABLE 4-2-continued

| Steel plate No. | Steel | Treatment conditions for forming protective rust: Water film thickness (μm) | Oxygen partial pressure (vol. %) | Keeping time at water film thickness less than 50 μm relative to one-hour keeping of water film (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|
| 24 | B | | | | Too small amount of rust | — | X | X | Comparative Example |
| 25 | A | 200 | 30 | 0 | 0.41 | 58 | X | X | Comparative Example |
| 26 | B | | | | 0.45 | 62 | X | X | Comparative Example |
| 27 | A | 400 | 20 | 0 | 0.43 | 57 | X | X | Comparative Example |
| 28 | B | | | | 0.48 | 60 | X | X | Comparative Example |
| 29 | A | 550 | 20 | ○ | 0.30 | 55 | X | X | Comparative Example |
| 30 | B | | | | 0.32 | 42 | X | X | Comparative Example |

TABLE 4-3

| Steel plate No. | Steel | Treatment conditions for forming protective rust: Water film thickness (μm) | Oxygen partial pressure (vol. %) | Keeping time at water film thickness less than 50 μm relative to one-hour keeping of water film (min) | Rust layer: *Thickness of extinction-developing rust/ Total rust thickness | Non-crystalline rust content (wt. %) | **Exposure test results: Fields area | Coastal area | Remarks |
|---|---|---|---|---|---|---|---|---|---|
| 31 | A | 550 | 60 | 0 | Too small amount of rust | — | X | X | Comparative Example |
| 32 | B | | | | Too small amount of rust | — | X | X | Comparative Example |
| 33 | A | 520 | 20 | 0 | 0.38 | 45 | X | X | Comparative Example |
| 34 | B | | | | 0.45 | 40 | X | X | Comparative Example |
| 35 | A | 550 | 20 | 0 | 0.35 | 45 | X | X | Comparative Example |
| 36 | B | | | | 0.47 | 46 | X | X | Comparative Example |

As seen from Tables 2–4, for the specimens treated under the conditions within the ranges according to the present invention, the ratio of the thickness of extinction-developing rust to the total rust thickness was as high as 0.53 to 0.75 for plain steel and 0.58 to 0.86 for weathering steel, and the content of non-crystalline rust was as high as 51 to 70 weight % for plain steel and 53 to 82 weight % for weathering steel, i.e., more than 50 weight % for both types of steel. Thus, the protective rust was formed in sufficient amounts on those specimens. Furthermore, even after the subsequent exposure in the field area and the coastal area, the occurrence of flowed rust was not found for the specimens treated under the conditions and within the ranges according to the present invention.

On the other hand, for any of the specimens treated under the conditions departing from the ranges according to the present invention, the ratio of the thickness of extinction-developing rust to the total rust thickness was as low as not more than 0.05, and the content of non-crystalline rust was less than 50 weight %. Further, the amount of formed rust was too small to cover the entire surface of some of those specimens, and the occurrence of flowed rust was found after the subsequent exposure in the fields area and the coastal area.

While the invention has been described in conjunction with the preferred embodiments described above, it is evident that many alternatives, modifications and variations would be apparent to those skilled in the arts. Accordingly, the preferred embodiments in the invention set forth above are intended to be illustrative and not limiting. Various changes may be made without departing from the spirit and scope of the invention.

What is claimed is:

1. A method of forming weathering protective rust on a surface of a steel product, comprising the steps of:

subjecting the steel product to a controlled atmosphere at a constant dew point; and repeatedly varying the temperature of said steel product in said controlled atmosphere between a first temperature that is at least 5° C. higher than the dew point and a second temperature that is at least 5° C. lower than the dew point so as to form the weathering protective rust on a surface of said steel product.

2. The method according to claim 1, wherein said controlled atmosphere contains 15 to 50 volume % of oxygen gas.

3. The method according to claim 1, wherein the step of repeatedly varying includes repeatedly varying the temperature of said steel product at a rate of increase of 0.1 to 2° C./minute and a rate of decrease of 0.01 to 2° C./minute.

4. The method according to claim 2, wherein the step of repeatedly varying includes repeatedly varying the temperature of said steel product at a rate of increase of 0.1 to 2° C./minute and a rate of decrease of 0.01 to 2° C./minute.

5. The method according to claim 4, wherein the step of repeatedly varying includes repeatedly varying the temperature of said steel product cyclically in said controlled atmosphere between said first temperature and said second temperature.

6. A method of forming weathering protective rust on a surface of a steel product, comprising the steps of:

subjecting the steel product to a controlled atmosphere in which the dew point is kept constant, the controlled atmosphere containing 15 to 50 volume % of oxygen gas; and maintaining the temperature of said steel product in the controlled atmosphere at a certain value in a temperature range that is between a temperature about 5° C. lower than the dew point and a temperature about 20° C. lower than the dew point so as to form the weathering protective rust on a surface of said steel product.

7. The method according to claim 6, wherein the step of maintaining further includes temporarily maintaining the temperature of the steel product at a temperature no lower than the dew point for at least five minutes.

8. A method of forming weathering protective rust on a surface of a steel product, comprising the steps of:

subjecting the steel product to a controlled atmosphere containing 15 to 50 volume % of oxygen gas;

forming a water film with a certain thickness in a range of 500 μm to 50 μm on a surface of said steel product while said steel product is subjected to the controlled atmosphere; and maintaining said water film of said certain thickness on the surface of said steel product so as to form the protective rust on the surface.

9. The method according to claim 8, further comprising temporarily keeping said water film at a thickness less than 50 μm for five or more minutes.

10. A method of producing a steel product having superior weathering, comprising the steps of:

subjecting the steel product to a controlled atmosphere in which the dew point is kept constant at a certain value; and repeatedly varying the temperature of said steel product in said controlled atmosphere between a temperature that is at least 5° C. higher than the dew point and a temperature that is at least 5° C. lower than the dew point such that weathering protective rust forms on said steel product.

11. A method of producing a steel product having superior weathering, comprising the steps of:

subjecting the steel product to a controlled atmosphere in which the dew point is kept constant, the controlled atmosphere containing 15 to 50 volume % of oxygen gas; and maintaining the temperature of said steel product in the controlled atmosphere at a certain value in a temperature range that is between a temperature about 5° C. lower than the dew point and a temperature about 20° C. lower than the dew point such that weathering protective rust forms on said steel product.

12. A method of producing a steel product having superior weathering, comprising the steps of:

subjecting the steel product to a controlled atmosphere containing 15 to 50 volume % of oxygen gas;

forming a water film with a certain thickness in a range of 500 μm to 50 μm on a surface of said steel product while said steel product is subjected to the controlled atmosphere; and maintaining said water film of said certain thickness on the surface of said steel product such that weathering protective rust forms on the surface.

13. The method of claim 12, wherein the weathering protective rust comprises at least 50 wt % of non-crystalline rust.

14. The method of claim 11, wherein the weathering protective rust comprises at least 50 wt % of non-crystalline rust.

15. The method of claim 11, wherein the controlled atmosphere contains 15 to 50 volume % of oxygen gas.

16. The method of claim 10, wherein the weathering protective rust comprises at least 50 wt % of non-crystalline rust.

17. The method of claim 8, wherein the weathering protective rust comprises at least 50 wt % of non-crystalline rust.

18. The method of claim 6, wherein the weathering protective rust comprises at least 50 wt % of non-crystalline rust.

19. The method of claim 6, wherein the controlled atmosphere contains 15 to 50 volume % of oxygen gas.

20. The method of claim 1, wherein the weathering protective rust comprises at least 50 wt % of non-crystalline rust.

* * * * *